US008749327B2

(12) United States Patent
Harmon

(10) Patent No.: US 8,749,327 B2
(45) Date of Patent: Jun. 10, 2014

(54) CIRCUIT INTERRUPTER TRIP APPARATUS AND METHOD

(75) Inventor: Jason Edward Harmon, Bristol, CT (US)

(73) Assignee: General Electric Company, Schenectady, NY (US)

( * ) Notice: Subject to any disclaimer, the term of this patent is extended or adjusted under 35 U.S.C. 154(b) by 859 days.

(21) Appl. No.: 12/233,262

(22) Filed: Sep. 18, 2008

(65) Prior Publication Data

US 2010/0066470 A1 Mar. 18, 2010

(51) Int. Cl.
*H01H 75/00* (2006.01)
*H01H 77/00* (2006.01)
*H01H 83/00* (2006.01)

(52) U.S. Cl.
USPC ..... 335/13; 335/6

(58) Field of Classification Search
USPC ..... 335/6, 13
See application file for complete search history.

(56) References Cited

U.S. PATENT DOCUMENTS

| | | | | |
|---|---|---|---|---|
| 5,003,139 | A * | 3/1991 | Edds et al. | 200/401 |
| 5,444,590 | A * | 8/1995 | LeComte et al. | 361/18 |
| 5,512,720 | A | 4/1996 | Coudert et al. | |
| 5,896,262 | A * | 4/1999 | Rae et al. | 361/94 |
| 6,040,746 | A | 3/2000 | Maloney et al. | |
| 6,281,458 | B1 | 8/2001 | Castonguay et al. | |
| 6,482,048 | B1 | 11/2002 | Fleege et al. | |
| 7,369,389 | B2 | 5/2008 | Vicente et al. | |
| 7,378,927 | B2 | 5/2008 | DiSalvo et al. | |
| 7,400,477 | B2 | 7/2008 | Campolo et al. | |
| 2003/0090848 | A1 | 5/2003 | Clarey et al. | |
| 2005/0001700 | A1 * | 1/2005 | Lewis | 335/14 |
| 2005/0068417 | A1 | 3/2005 | Kreiner et al. | |
| 2008/0136567 | A1 | 6/2008 | Chelloug | |
| 2008/0151463 | A1 | 6/2008 | Dwyer et al. | |
| 2008/0157751 | A1 | 7/2008 | Jones | |
| 2008/0204947 | A1 * | 8/2008 | Shea et al. | 361/3 |
| 2010/0046129 | A1 * | 2/2010 | Mikrut | 361/45 |
| 2010/0085430 | A1 * | 4/2010 | Kreiner et al. | 348/143 |

FOREIGN PATENT DOCUMENTS

| | | |
|---|---|---|
| CN | 2629206 Y | 7/2004 |
| CN | 2720615 Y | 8/2005 |

OTHER PUBLICATIONS

European Search Report for Application No. 09170123.5; Date of Mailing: Jan. 4, 2010; 5 pgs.
European Office Action for EP Application No. 09170123.5-2214, dated Oct. 19, 2010, pp. 1-3.
Unofficial Translation of CN Official Action from CN Application No. 200910178699.X dated Apr. 27, 2013.
Unofficial translation of CN Search Report from CN Application No. 200910178699.X dated Apr. 19, 2013.

* cited by examiner

*Primary Examiner* — Bernard Rojas
(74) *Attorney, Agent, or Firm* — Cantor Colburn LLP

(57) ABSTRACT

A circuit interrupter trip apparatus operably connected to an operating mechanism of a circuit interrupter includes a sensor and a switch operably connected and responsive to the sensor. The switch is positioned such that the sensor changes the operating state of the switch in response to detection of a predetermined electrical condition, such as an electrical fault. A controller is operably connected to the switch and is configured to activate the operating mechanism in response to a change in the operating state of the switch.

19 Claims, 5 Drawing Sheets

CIRCUIT INTERRUPTER TRIP APPARATUS AND METHOD

BACKGROUND

Embodiments of the invention disclosed herein relate to circuit interrupters or circuit breakers. More specifically, embodiments of the invention relate to lowering the force required of sensors, such as fault detectors, in trip apparatus for circuit interrupters or circuit breakers.

Circuit interrupters or circuit breakers use various trip devices to detect a fault and open a circuit to which they are connected. The trip devices include sensors and activate an operating mechanism of the breaker that moves a movable contact out of engagement with a fixed contact when the fault is detected. Some circuit breakers are also configured to trip other circuit breakers remotely.

One type of trip device used in circuit breakers is an electromagnetic trip device, which is generally used to open the breaker during a surge event. An example of an electromagnetic trip device is a solenoid serially connected to a line conductor of the breaker and arranged to activate the operating mechanism when current in the line conductor exceeds a predetermined level.

Another type of trip device used in circuit breakers is a thermal trip device, which is generally used to open the breaker during an overload event. An example of a thermal trip device is a thermal element, typically a bimetallic element (bimetal), serially connected to a line conductor of the breaker and arranged to activate the operating mechanism when current in the line conductor has exceeded a predetermined level for a predetermined amount of time. This type of bimetal trip device is known in the art as a directly-heated bimetal. Other bimetal trip devices may be thermally connected to a line conductor through a heating element that itself is serially connected to the line conductor. This type of bimetal/heater trip device is known in the art as an indirectly-heated bimetal.

Many circuit breakers employ both electromagnetic and thermal trip devices in a so-called thermal-magnetic trip unit. In a thermal-magnetic trip unit, the electromagnet or the thermal element or both may be required to provide or overcome a relatively high trip force. The amount of force required to trip the mechanism of some breakers can be as much as 4 Newtons (N), and larger breakers can have much higher trip forces. Additionally, some arrangements have a trip bar, which is what the trip device is arranged to move, directly attached to the mechanism. This couples the mechanism and trip device(s).

Some designs use a secondary latching system, such as is used in many interchangeable trip unit designs, which can reduce the force required by the trip device(s) to trip the mechanism. In an interchangeable trip unit configuration, the trip device contacts a trip bar that is part of a secondary latching system containing stored energy in the form of springs. The electromagnetic or thermal trip device, or both, can then release this secondary latching system, which then trips the mechanism. This configuration reduces coupling between the trip device and the mechanism, but does not eliminate the coupling and adds a significant amount of complication to the design. The second latching system also adds cost. Additionally, though the force required to release the latching system is reduced, the required force is still somewhat large. For example, in a breaker requiring about 4 N to trip the mechanism, the second latching system can still require a relatively large force of about 2.5 N.

There is thus a need for a trip apparatus that decouples the apparatus from the operating mechanism and reduces the amount of force required from the fault detector(s) to trip the mechanism.

Many circuit breakers also use auxiliary trip systems. Auxiliary trip systems can be used in several ways, but are typically used to trip a breaker more rapidly than a primary trip device of the breaker. For example, a typical primary electromagnetic trip device can have an intentional delay, such as one cycle, to give a downstream breaker an opportunity to trip and eliminate a fault danger to the upstream breaker. This intentional delay may be disadvantageous in higher current surge events, and thus an auxiliary trip device can be employed to trip the breaker more rapidly under such circumstances.

Prior art auxiliary trip systems include, for example, pressure powered auxiliary trip systems and magnetic trip systems. Several design constraints make auxiliary trip systems particularly difficult to design. Most auxiliary trip systems must harvest residual energy in the breaker to create mechanical energy to trip the breaker. For example, in pressure powered auxiliary trip systems, breaker exhaust gas pressure is used as an energy source, and in magnetic trip auxiliary systems, magnetic force generated by current flow is used. In both example types, the auxiliary trip system must harvest enough energy to trip the mechanism and convert the residual energy to a relatively high amount of mechanical force, which may be difficult to accomplish, particularly for pressure powered auxiliary trip systems.

There is thus a need for an auxiliary trip system that requires less energy for operation and that is easier to tune.

BRIEF DESCRIPTION

A circuit interrupter trip apparatus operably connected to an operating mechanism of a circuit interrupter includes a sensor, such as a fault detector, and a switch operably connected and responsive to the sensor. The sensor is configured to change the operating state of the switch in response to detection of a predetermined condition, such as an electrical fault. A controller is operably connected to the switch and is configured to activate the operating mechanism in response to a change in the operating state of the switch.

In addition, a circuit interrupter including a first electrical contact and a second electrical contact disposed in separable communication with the first electrical contact has an operating mechanism disposed and configured to selectively open and close the first and second electrical contacts. A first trip device is operably connected to the operating mechanism to activate the operating mechanism in response to at least one first condition being met, and a second trip device is operably connected to the operating mechanism to activate the operating mechanism in response to at least one second condition being met. The second trip device includes a controller configured to issue a trip command, a switch having at least two operating states, the switch being in electrical communication with the controller, and a sensor disposed and configured to change the operating state of the switch in response to detecting a predetermined electrical condition, the predetermined electrical condition being an at least one second condition. An actuator operably connected to the controller and the operating mechanism is disposed and configured to activate the operating mechanism in response to the trip command from the controller. The controller is configured to issue the trip command to the actuator in response to the change in the operating state of the switch.

A circuit interrupter trip method includes providing a sensor, providing a switch, and providing a controller. The method also includes connecting the switch to controller, configuring the sensor such that when a predetermined condition is detected it changes an operating state of the switch. In embodiments, the method continues by monitoring the operating state of the switch with the controller and activating an operating mechanism of a circuit interrupter with the controller when the operating state of the switch changes.

DETAILED DESCRIPTION

Figure 1:
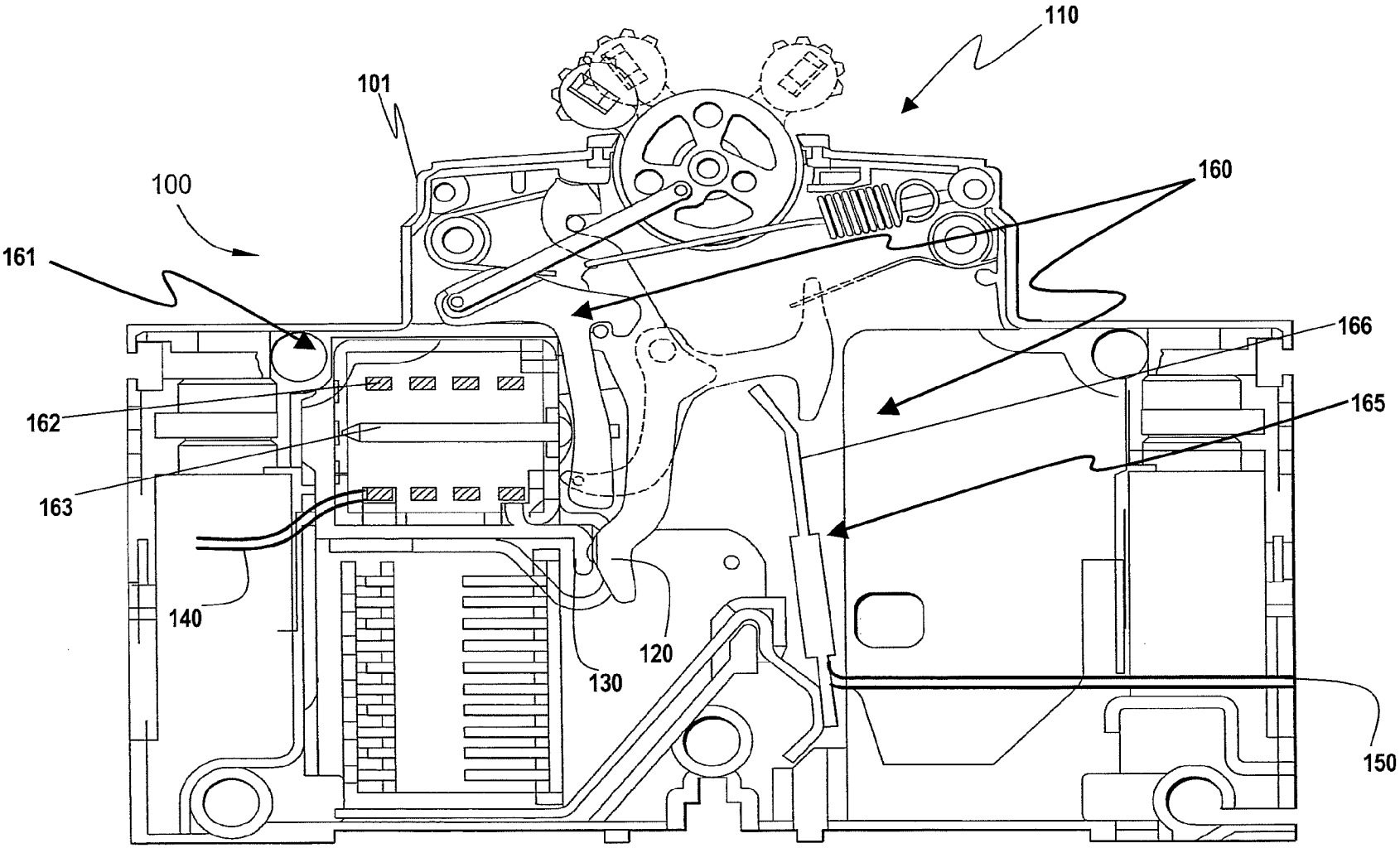
FIG. 1 (PRIOR ART)
FIG. 1 shows a typical circuit breaker according to the prior art.

With reference to the accompanying Figures, examples of a trip apparatus according to embodiments of the invention are disclosed as a unit unto itself, as part of a typical thermal-magnetic circuit breaker, and as an auxiliary trip apparatus. For purposes of explanation, numerous specific details are shown in the drawings and set forth in the detailed description that follows in order to provide a thorough understanding of embodiments of the invention. It will be apparent, however, that embodiments of the invention may be practiced without these specific details. In other instances, well-known structures and devices are schematically shown in order to simplify the drawing.

As seen in FIG. 1, a circuit breaker 100 generally comprises a housing 101 supporting an operating mechanism 110 that selectively moves a movable contact 120 into and out of engagement with a fixed contact 130. The fixed contact 130 is typically connected to a line conductor 140 and the movable contact is typically connected to a load conductor 150. The breaker 100 preferably includes at least one primary trip device 160, such as an electromagnetic trip device 161 and/or a thermal trip device 165, that activates the operating mechanism 110 when predetermined conditions have been met. In the case of an example electromagnetic trip device 161, a solenoid 162 is connected to a line conductor 140 of the breaker 100 and is arranged so that a plunger 163 of the solenoid 162 will activate the operating mechanism 110 in response to a surge event, such as when current in the line conductor 140 exceeds a predetermined level. In the case of an example thermal trip device 165, a thermal element 166, such as a bimetallic element (bimetal), is connected to the line conductor 140 and is arranged so that the thermal element 166 activates the operating mechanism 110 in response to an overload event. When a bimetallic element is used, the bimetallic element heats in response to current load over time and deforms, until, when a predetermined current has been exceeded for a predetermined amount of time, it activates the operating mechanism 110.

While embodiments of the invention are herein disclosed having a movable and a fixed contact, a solenoid as an example electromagnetic trip device, and a bimetal as a thermal trip device, it will be appreciated that the scope of the invention is not so limited. For example, embodiments of the invention may also employ a pair of contacts where both are movable, or may employ more than one pair of contacts, such as in a double-break system. Other embodiments may employ non-solenoid electromagnetic trip devices such as a magnet/armature arrangement, and may employ other thermal elements such as shape memory devices for the thermal trip device, for example. All such alternative embodiments are contemplated and considered within the scope of the invention disclosed herein.

Figure 2:
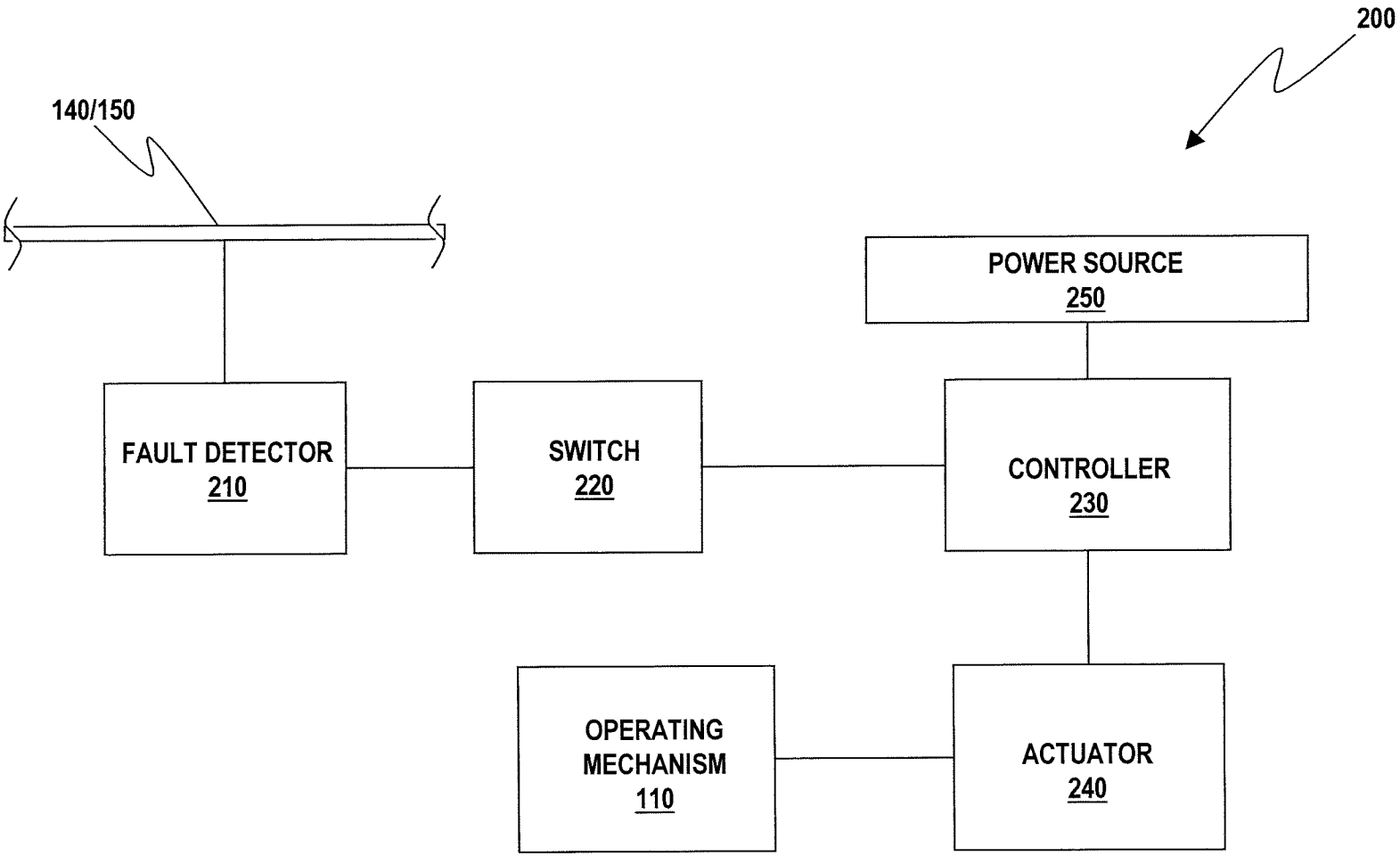
FIG. 2 shows a trip apparatus according to an embodiment of the invention.

As seen in FIG. 2, a trip apparatus 200 according to an embodiment can include a sensor 210 that monitors a component, such as the line conductor 140, and a switch 220, such as a microswitch. The switch 220 has at least two operating states including an ON state and an OFF state. The fault detector 210 is arranged or configured to change the operating state of the switch 220 when a predetermined electrical condition, such as a fault, is detected on, via, or in the monitored component. The fault detector 210 can be an electromagnetic trip device, a thermal trip device, an arc flash trip device, or other suitable sensor, fault detector, or trip device that can produce the force necessary to change the operating state of the switch 220. The predetermined electrical condition can include, but is not limited to, for example, current exceeding a predetermined value or level, such as during a current surge event, current exceeding a predetermined value or level for a predetermined amount of time, such as in an overload event, and the occurrence of an arc flash.

The switch 220 is in electrical communication with a controller 230 that is also in electrical communication with an actuator 240. The controller 230 monitors the operating state of the switch 220 and/or responds to a change in the operating state of the switch 220 and activates the actuator 240 when appropriate. In an embodiment, a power source 250 is included to provide power to the controller 230, the actuator 240, and/or the switch 220. The power source 250 can be a current transformer (CT), battery, or other suitable power source.

The controller 230 of an embodiment is a printed circuit board (PCB) or board computer in electrical communication with the switch 220 and the actuator 240 and configured to issue or send a trip signal to the actuator 240 in response to a change in the switch operating state. In alternative embodiments, the controller can include a microprocessor in electrical communication with the switch 220 and the actuator 240 and is equipped with logic that activates the actuator 240 in response to a change in the operating state of the switch that also performs other functions.

While the controller 230 has been described in the example embodiment as a board computer, it can be any suitable electronic device that can receive data and computer executable instructions, execute the instructions to process the data, and present results. The controller 230 can also be, but is not limited to, a microprocessor, microcomputer, a minicomputer, an optical computer, a board computer, a complex instruction set computer, an application specific integrated circuit, a reduced instruction set computer, an analog computer, a digital computer, a solid-state computer, a single-board computer, or a combination of any of these. Instructions can be delivered to the controller 230 via an electronic data card, voice activation, manual selection and control, electromagnetic radiation, and electronic or electrical transfer.

An embodiment of the invention can include computer-implemented processes and apparatus for practicing such processes, such as the controller 230. Additionally, an embodiment can include a computer program product including computer code, such as object code, source code, or executable code, on tangible media, such as magnetic media (floppy diskettes, hard disc drives, tape, etc.), optical media (compact discs, digital versatile/video discs, magneto-optical discs, etc.), random access memory (RAM), read only memory (ROM), flash ROM, erasable programmable read only memory (EPROM), or any other computer readable storage medium on which the computer program code is stored and with which the computer program code can be loaded into and executed by a computer. When the computer executes the computer program code, it becomes an apparatus for practicing the invention, and on a general purpose microprocessor, specific logic circuits are created by configuration of the microprocessor with computer code segments. A technical effect of the executable instructions is to activate an actuator when a fault is detected by a fault detector.

The computer program code is written in computer instructions executable by the controller, such as in the form of software encoded in any programming language. Examples of suitable programming languages include, but are not limited to, assembly language, VHDL (Verilog Hardware Description Language), Very High Speed IC Hardware Description Language (VHSIC HDL), FORTRAN (Formula Translation), C, C++, C#, Java, ALGOL (Algorithmic Language), BASIC (Beginner All-Purpose Symbolic Instruction Code), APL (A Programming Language), ActiveX, HTML (HyperText Markup Language), XML (eXtensible Markup Language), and any combination or derivative of one or more of these.

Figure 3:
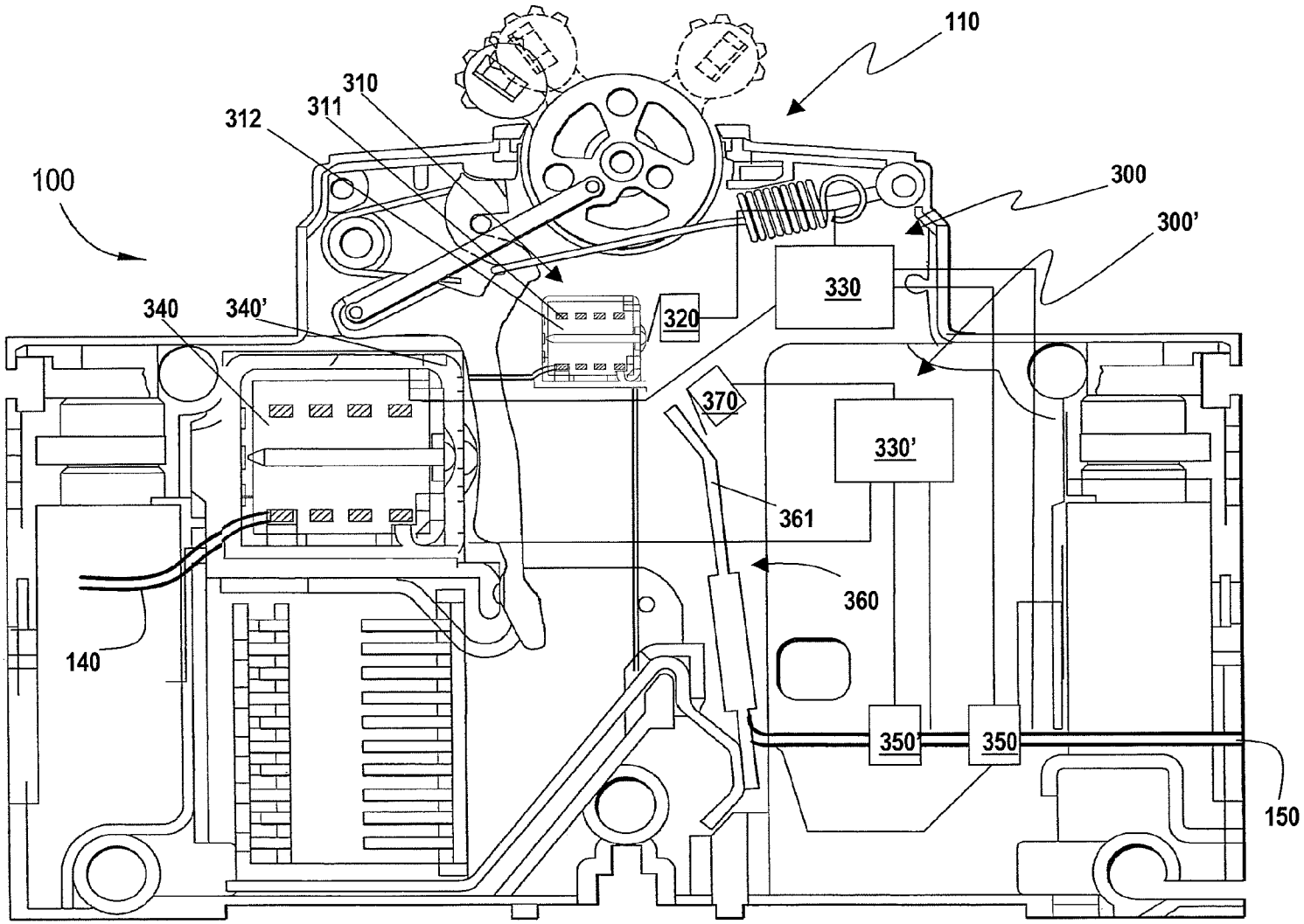
FIG. 3 shows a circuit breaker having a trip apparatus according to an embodiment of the invention.

As seen in FIG. 3, the trip apparatus 300, 300' of embodiments can be used as a primary trip device. In place of the electromagnetic primary trip device 161 seen in the prior art device of FIG. 1, a first trip apparatus 300 of an embodiment includes an electromagnetic sensor 310 connected to the line conductor of a breaker and positioned so that it facilitates a change in the operating state of a first switch 320. The electromagnetic fault detector 310 includes a solenoid with a coil 311 connected to the line conductor and a plunger 312 such that when a predetermined current value or level is exceeded in the line conductor, the plunger 312 moves to change the operating state of the switch 320. The controller 330 responds to the change in the operating state of the first switch 320 by activating the actuator 340, which trips the operating mechanism 110 of the breaker 100. While a coil 311 and plunger 312 (solenoid) type electromagnetic sensor has been described by way of example, it should be clear that other electromagnetic sensors can be employed within the scope of embodiments. To supply power required for the switch 320, the controller 330, and/or the actuator 340, a power source 350, such as a CT, is provided.

As seen in the exemplary embodiment of FIG. 3, a second trip apparatus 300' according to an embodiment is used in place of the thermal primary trip device. The second trip apparatus 300' includes a thermal sensor 360 connected to the line conductor 140 or the load conductor 150 of the breaker 100. The thermal sensor 360 includes a thermal element 361, such as a bimetal, connected to the line conductor such that the thermal element heats in response to a current running through the line conductor 140 or load conductor 150. When the current exceeds a predetermined value or level of current for a predetermined amount of time, the thermal sensor's thermal element 361 deforms and changes the operating state of a second switch 370 instead of acting on the operating mechanism of the breaker 100 directly. A controller 330' responds to the change in the operating state of the second switch 370 by activating an actuator 340', which trips the mechanism of the breaker 100. To supply power required for the switch 370, the controller 330', and/or the actuator 340', a power source 350', such as a CT, is provided. While a complete second trip apparatus is shown in the embodiment shown in FIG. 3, alternative embodiments can share the controller 330, actuator 340, and/or power source 350 of the first apparatus 300. It should also be clear that both primary trip devices need not be replaced and that just one of the primary trip devices could be replaced with embodiments.

Figure 4:
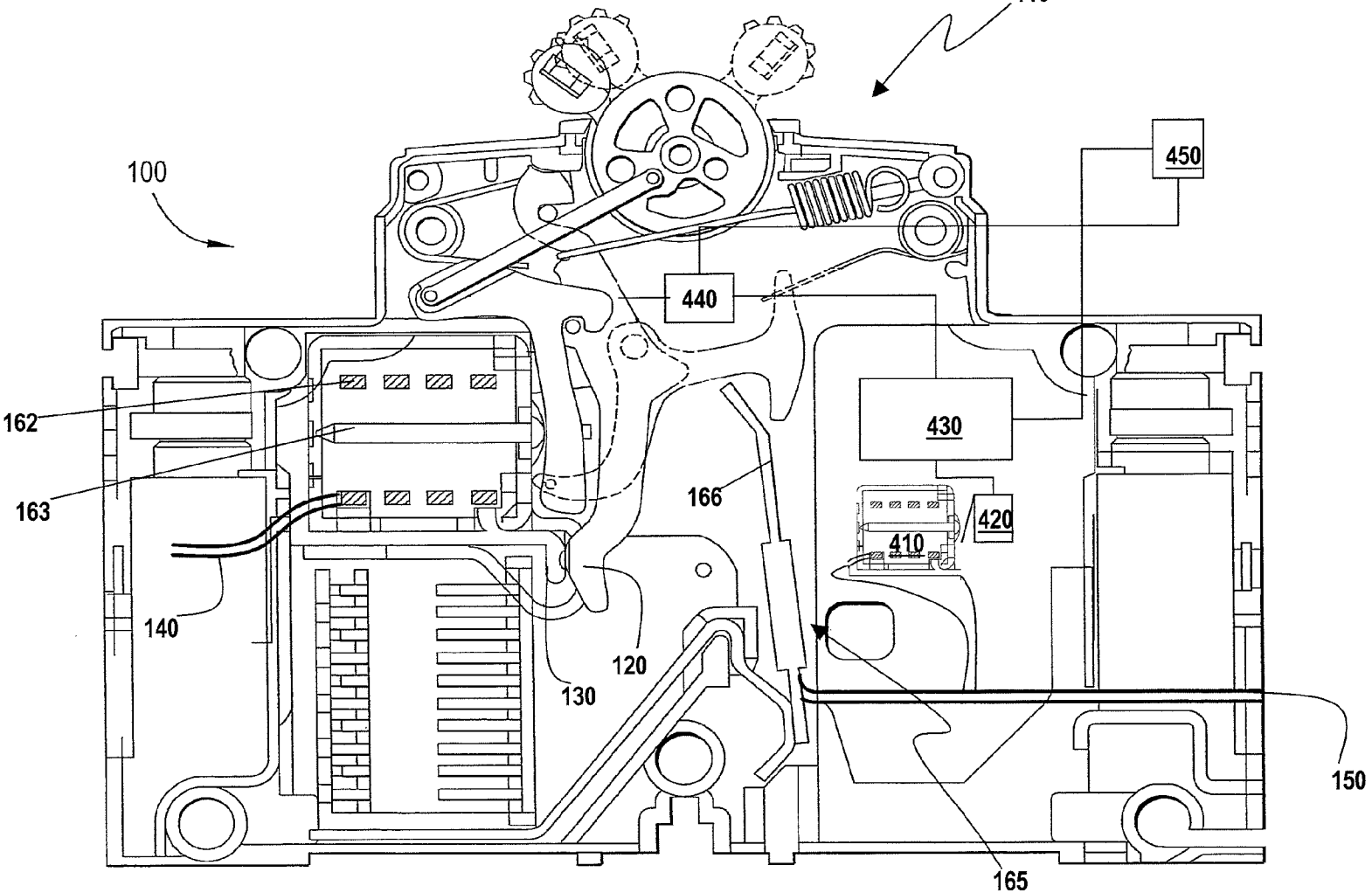
FIG. 4 shows a circuit breaker in which a trip apparatus according to an embodiment of the invention is employed as an auxiliary trip unit.

As seen in FIG. 4, embodiments can be employed as an auxiliary trip unit. For illustrative purposes, a circuit breaker 100 employing a thermal-magnetic trip unit is shown in conjunction with an embodiment of the invention and including electromagnetic and thermal primary trip devices 161, 165. As an auxiliary trip device, a sensor 410 is connected to, for example, a load conductor 150 of the breaker 100. The sensor 410 can be an electromagnetic sensor as shown, a different type of electromagnetic sensor, a thermal sensor, an arc flash sensor, or other type of sensor as desired. As shown, the sensor 410 monitors current in the load conductor 150 and changes the operating state of the switch 420 in response to current in the load conductor exceeding a predetermined current value or level, such as, for example, a significantly higher current than that which trips one or more primary trip device(s). A controller 430 connected to the switch 420 activates an actuator 440 when the operating state of the switch 420 changes, and the actuator 440 trips the operating mechanism 110 of the breaker 100. A power source 450 provides power for the controller 430 and/or actuator 440 and can take the form of a current transformer, a battery, an AC source, or other suitable power source. In addition, while the auxiliary trip arrangement shown in FIG. 4 has the actuator 440 arranged in the same breaker in which the sensing is occurring, it should be clear that the auxiliary trip arrangement could instead control a remote actuator 440 in a remote breaker, and that such a remote breaker could be parallel, upstream, or downstream as required for the particular power system in which the breakers are installed.

In FIGS. 2-4, the switches are shown in configurations in which they are in an OFF state and changed, at least transiently, to an ON state by the fault detectors. The switches could instead be arranged so that they are held in the ON state by the sensors and changed, at least transiently, to the OFF state when a fault is detected. For example, in an undervoltage release arrangement, such as the embodiment shown schematically in FIG. 5, the trip apparatus 500 monitors line voltage with a fault detector 510, in this case a UVR solenoid including a coil 511 and a plunger 512. The plunger 512 holds the switch 520 in an ON position until the line voltage below a predetermined level, such as the drop threshold of the solenoid. Once the line voltage drops below the predetermined level, the controller 530 responds by activating the actuator 540 to trip the operating mechanism 110 of the breaker 100.

By using switches, and especially microswitches, in trip apparatus to trigger an actuator to trip, embodiments significantly reduce the amount of force a sensor, such as a fault detector, must produce to trip a breaker. The sensor need only produce enough force to change the state of the switch, which results in the actuator tripping the breaker. The actuator provides the force previously required of the sensor to trip the breaker. Sensors in embodiments can thus be much smaller than those in prior art devices, which can result in cost reductions and size reductions, but can also produce a more easily calibrated trip apparatus.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

The invention claimed is:

1. A circuit interrupter trip apparatus operably connected to an operating mechanism of a circuit interrupter, the trip apparatus comprising:

a sensor;

a microswitch operably connected and responsive to the sensor, said sensor configured to change the operating state of the switch in response to detection of a predetermined electrical condition; and a computer controller configured and disposed to receive and execute computer executable instructions, the controller being operably connected to the switch and configured to activate the operating mechanism in response to a change in the operating state of the switch.

2. The trip apparatus of claim 1 wherein the sensor is an electro-mechanical sensor having a mechanical output arranged to change the operating state of the microswitch in response to a predetermined value of the current being exceeded.

3. The trip apparatus of claim 2 wherein the electro-mechanical sensor is a solenoid connected to a line conductor and responsive to a current of the line conductor such that the mechanical output facilitates a change in the operating state of the microswitch in response to a predetermined value of the current being exceeded.

4. The trip apparatus of claim 3 wherein the solenoid facilitates a change in the operating state of the microswitch to OFF in response to a predetermined value of the current being exceeded.

5. The trip apparatus of claim 3 wherein the solenoid facilitates a change in the operating state of the microswitch to ON in response to a predetermined value of the current being exceeded.

6. The trip apparatus of claim 1 wherein the sensor is a thermal sensor arranged to change the operating state of the switch in response to a predetermined condition.

7. The trip apparatus of claim 6 wherein the thermal sensor is a bimetal connected to a line conductor such that the bimetal facilitates a change in the operating state of the switch in response to a predetermined value of current magnitude through the bimetal being exceeded for a predetermined amount of time.

8. The trip apparatus of claim 1 wherein the sensor is an arc flash detector arranged to change the operating state of the switch in response to an arc flash event.

9. A circuit interrupter comprising:

a first electrical contact;

a second electrical contact disposed in separable communication with the first electrical contact;

an operating mechanism disposed and configured to selectively open and close the first and second electrical contacts;

a first trip device operably connected to the operating mechanism to activate the operating mechanism in response to at least one first condition being met; and a second trip device operably connected to the operating mechanism to activate the operating mechanism in response to at least one second condition being met, the second trip device comprising:

a computer controller configured and disposed to receive and execute computer readable instructions, the controller being configured to issue a trip command;

a microswitch having at least two operating states, the switch being in electrical communication with the controller;

a sensor disposed and configured to change the operating state of the switch in response to detecting a predetermined electrical condition, the predetermined electrical condition being an at least one second condition;

an actuator operably connected to the controller and the operating mechanism, the actuator disposed and configured to activate the operating mechanism in response to the trip command from the controller; and wherein the controller is configured to issue the trip command to the actuator in response to the change in the operating state of the switch.

10. The circuit interrupter of claim 9 wherein the sensor is an electro-mechanical sensor having a mechanical output disposed and configured to change the operating state of the microswitch in response to a predetermined electrical condition.

11. The circuit interrupter of claim 10 wherein the electro-mechanical sensor is a solenoid operably connected to one of the line conductor and the load conductor and responsive to a current thereof such that when the current exceeds a predetermined value, the mechanical output changes the operating state of the microswitch.

12. The circuit interrupter of claim 11 wherein the plunger changes the operating state of the microswitch to ON in response to a predetermined value of the current being exceeded.

13. The circuit interrupter of claim 9 wherein the sensor is a thermal sensor arranged to change the operating state of the switch in response to a predetermined condition.

14. The circuit interrupter of claim 13 wherein the thermal sensor is a bimetal connected to a line conductor such that the bimetal facilitates a change in the operating state of the switch in response to a predetermined value of current magnitude through the bimetal being exceeded for a predetermined amount of time.

15. The circuit interrupter of claim 9 wherein the sensor is an arc flash detector arranged to change the operating state of the switch in response to an arc flash event.

16. A circuit interrupter trip method comprising:

providing a sensor;

providing a microswitch;

providing a computer controller configured to receive and execute computer readable instructions;

connecting the microswitch to the computer controller;

configuring the sensor to change an operating state of the microswitch when a predetermined condition is detected;

monitoring the operating state of the microswitch with the computer controller; and activating an operating mechanism of a circuit interrupter with the computer controller when the operating state of the microswitch changes.

17. The method of claim 16 wherein providing a sensor comprises providing an electro-mechanical sensor.

18. The method of claim 16 wherein providing a sensor comprises providing a thermal sensor arranged to change the operating state of the switch in response to a predetermined condition.

19. The method of claim 16 wherein providing a sensor comprises providing an arc flash detector arranged to change the operating state of the switch in response to an arc flash event.

* * * * *

UNITED STATES PATENT AND TRADEMARK OFFICE

CERTIFICATE OF CORRECTION

Figure 5:
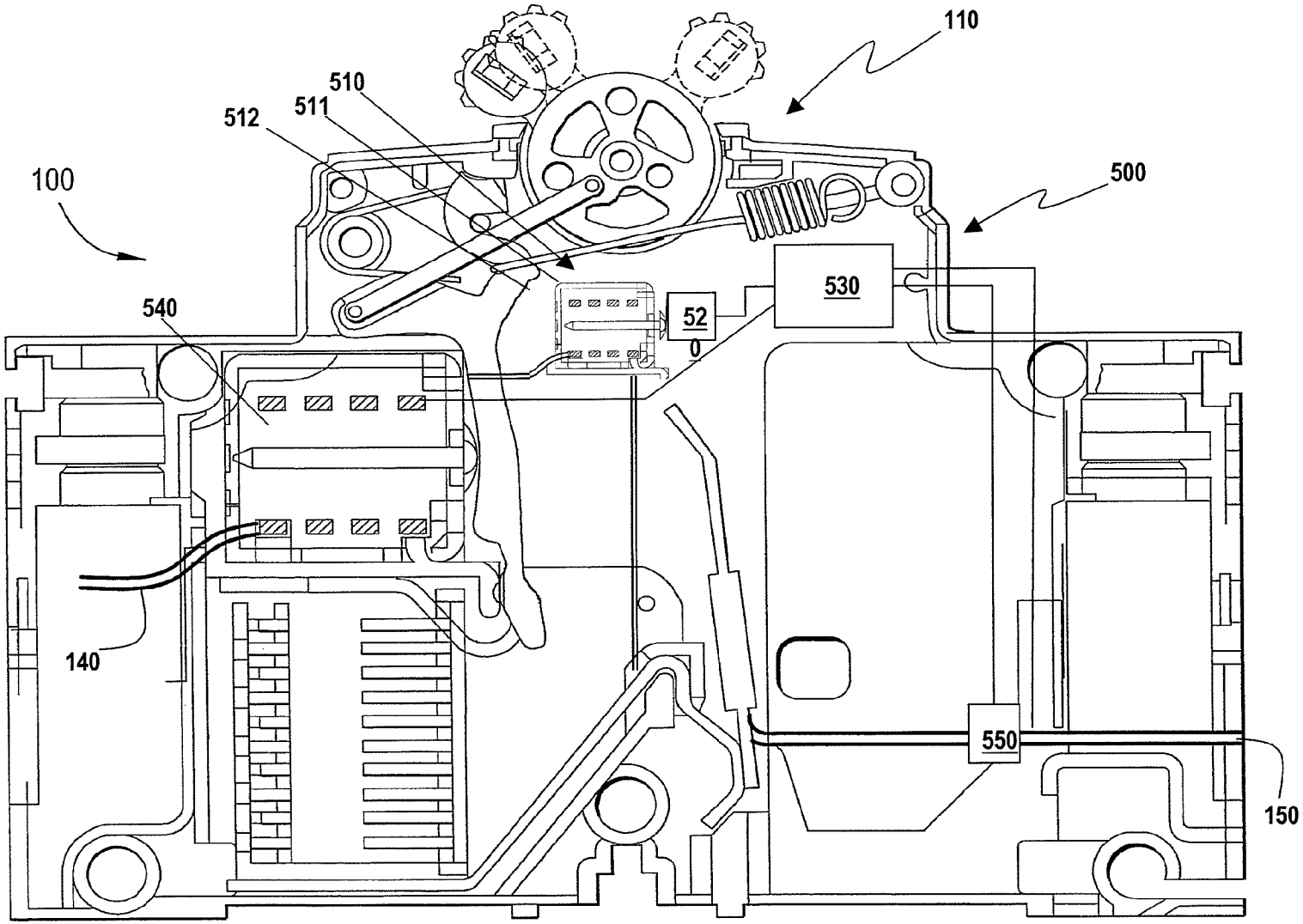
FIG. 5 shows a circuit breaker in which a trip apparatus according to an embodiment is employed as an undervoltage release trip apparatus.

PATENT NO. : 8,749,327 B2
APPLICATION NO. : 12/233262
DATED : June 10, 2014
INVENTOR(S) : Harmon It is certified that error appears in the above-identified patent and that said Letters Patent is hereby corrected as shown below:

In the Drawings:

In Fig. 5, Sheet 5 of 5, delete " 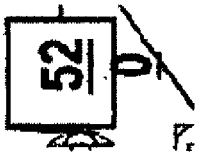 " and insert -- 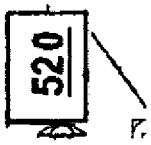 --, therefor.

Signed and Sealed this
Eleventh Day of November, 2014

Michelle K. Lee

Michelle K. Lee
*Deputy Director of the United States Patent and Trademark Office*